US006572811B1

(12) United States Patent
Heirich

(10) Patent No.: US 6,572,811 B1
(45) Date of Patent: Jun. 3, 2003

(54) METHOD OF FORMING A CEMENTITIOUS PANEL

(75) Inventor: William C. Heirich, Littleton, CO (US)

(73) Assignee: Custom Building Systems, Inc.

( * ) Notice: Subject to any disclaimer, the term of this patent is extended or adjusted under 35 U.S.C. 154(b) by 0 days.

(21) Appl. No.: 09/400,577

(22) Filed: Sep. 21, 1999

Related U.S. Application Data

(60) Provisional application No. 60/101,305, filed on Sep. 22, 1998.

(51) Int. Cl.[7] ..... B28B 1/08; B28B 5/00; B28B 7/06; B28B 7/10; B28B 7/20

(52) U.S. Cl. ..... 264/426; 264/489; 264/490; 264/71; 264/511; 264/271.1; 264/275; 264/297.7; 264/313; 264/318; 264/333; 264/334; 264/102; 425/125; 425/126.1; 425/440; 249/66.1; 249/93; 414/752.1; 414/797; 52/404.1; 52/405.1

(58) Field of Search ..... 264/426, 489, 264/490, 245, 256, 259, 271.1, 275, 333, 318, 313, 334, 511, 102, 297.7, 71; 52/404.1, 405.1; 425/125, 126.1, 440; 249/93, 66.1; 414/752.1, 797

(56) References Cited

U.S. PATENT DOCUMENTS 2,819,495 A * 1/1958 Krausz
2,855,653 A * 10/1958 Kastenbein
3,061,904 A * 11/1962 Wise
3,204,316 A * 9/1965 Jackson
3,353,220 A * 11/1967 Lenoble
3,415,388 A * 12/1968 Hornlein et al.
3,694,533 A * 9/1972 Kelsey ..... 264/90
3,763,542 A * 10/1973 Gutnajer ..... 29/400
4,083,908 A * 4/1978 Kalvenes et al. ..... 264/82
4,093,690 A 6/1978 Murray ..... 264/82
4,338,135 A 7/1982 Cook ..... 106/97
4,804,173 A * 2/1989 Pol et al. ..... 271/11
5,147,459 A * 9/1992 Lynn et al. ..... 106/601
5,245,149 A * 9/1993 Pinna et al. ..... 219/10.55 A

FOREIGN PATENT DOCUMENTS

DE 3326856 A1 * 2/1985

* cited by examiner

*Primary Examiner*—Jan H. Silbaugh
*Assistant Examiner*—Michael I. Poe
(74) *Attorney, Agent, or Firm*—Dunlap Codding & Rogers

(57) ABSTRACT

A method is provided for rapidly forming a cementitious panel. A cementitious mixture is introduced into a mold configured to provide the desired surface appearance and profile of the cementitious panel. The cementitious mixture is then subject to an accelerated curing process by applying microwave energy to the cementitious mixture for a predetermined time period. After a relatively short resting or cooling period, the resulting cementitious panel is ready to be removed from the mold.

17 Claims, 17 Drawing Sheets

METHOD OF FORMING A CEMENTITIOUS PANEL

CROSS REFERENCE TO RELATED APPLICATIONS

This application claims the benefit of U.S. Provisional Application Ser. No. 60/101,305, filed Sept 22, 1998, which is hereby incorporated by reference.

BACKGROUND OF THE INVENTION

1. Field of the Invention.

The present invention relates generally to cementitious building panels, and more particularly, but not by way of limitation, to an improved method of forming a cementitious building panel.

2. Brief Description of the Related Art.

Concrete has long been used as a construction material because of its many beneficial qualities. For example, concrete is strong, particularly in compressive modes, and durable under a wide range of environmental and temperature conditions. Further, concrete is fireproof and insect proof. Finally, it can be formed into any desired shape or configuration.

The beneficial qualities of concrete listed above make concrete an ideal material for the fabrication of roofing, flooring, and exterior walls for all types of buildings ranging from residential to commercial and industrial. To this end, cementitious building panels have been formed in the past by pouring a cementitious mixture into a mold configured to provide the cementitious panel with a desired exterior wall texture. For example, the cementitious panel may be formed to have a stucco, brick, limestone, or cinder block appearance. The cementitious panels are in turn secured to the frame structure of a building in a side by side relation.

While the use of such cementitious panels has been well received in the building industry, efficiencies nevertheless have been experienced in the manufacturing process. To begin, the time generally required to form a cementitious panel, which includes pouring the cementitious mixture into the mold and allowing the cementitious mixture to dry sufficiently to permit the panel to be removed from the mold without damaging the panel, has been approximately eight hours. As such, if it were desirable to produce 100 panels in an eight hour production shift, for example, approximately 100 molds would be needed for each different panel profile. The need for this many molds requires an extensive capital investment and results in the need for extensive mold storage space.

Another inefficiency is experienced in forming cementitious panels which are intended to replicate brick or other masonry forms on which there is a mortar joint that is distinctive in color from the face color of the brick. These types of products have been formed in the past by hand pouring a first cementitious mixture having a brick color into spaced apart brick face cavities in measured amounts and then pouring a second cementitious mixture having a desired mortar joint color over the first cementitious mixture. It is important that the two pours be made while both cementitious mixtures are still in a liquid state so that their common surfaces are free to commingle and thereby avoid the formation of a "cold joint". While it is possible to hand pour the individual brick face cavities, this is an extremely slow and time consuming task requiring experienced personnel twenty to thirty man minutes per 4 ft.×8 ft. panel.

To this end, a need exists for a method of forming lightweight cementitious building panels, both single color and multiple color, in a more time and cost efficient manner. It is to such a method that the present invention is directed.

SUMMARY OF THE INVENTION

The present invention is directed to a method of forming a cementitious panel. The method includes the steps of: (1) providing a mold configured to provide the desired surface appearance and profile of the cementitious panel; (2) introducing a cementitious mixture into the mold; (3) curing the cementitious mixture to form a cementitious panel by applying microwave energy to the cementitious mixture for a predetermined time period; and (4) removing the cementitious panel from the mold.

In another aspect, the present invention is directed to a method of forming a cementitious panel having a front face formed to have a brick appearance which includes a plurality of rectangularly shaped brick portions separated from each other by a mortar joint portion. The method includes the steps of: (1) providing a mold having a plurality of spaced apart brick face cavities; (2) introducing a first cementitious mixture into each of the brick faced cavities of the mold; (3) introducing a second cementitious mixture, on top of the first cementitious mixture, that is distinctive in color from the first cementitious mixture introduced into the brick face cavities so as to produce the mortar joint portion; (4) curing the first and second cementitious mixtures to form a cementitious panel by applying microwave energy to the cementitious mixture for a predetermined time period; and (5) removing the cementitious building panel from the mold.

The objects, features and advantages of the present invention will become apparent from the following detailed description when read in conjunction with the accompanying drawings and appended claims.

DETAILED DESCRIPTION OF THE INVENTION

The present invention is generally directed to a process for forming building panels from a glass fibre reinforced cementitious mixture. The building panels to be formed are generally 4 ft.×8 ft. with a nominal thickness of approximately ⅞ inch to 1 inch. The cementitious panels are becoming more widely used for forming exterior walls due to their durability, their ease of installation, and their moldability into any desired surface texture. The cementitious panels are secured to the frame structure of a building in a side by side relation as described below. The present invention provides a method for forming cement into building panels in a more economical manner.

Figure 1:
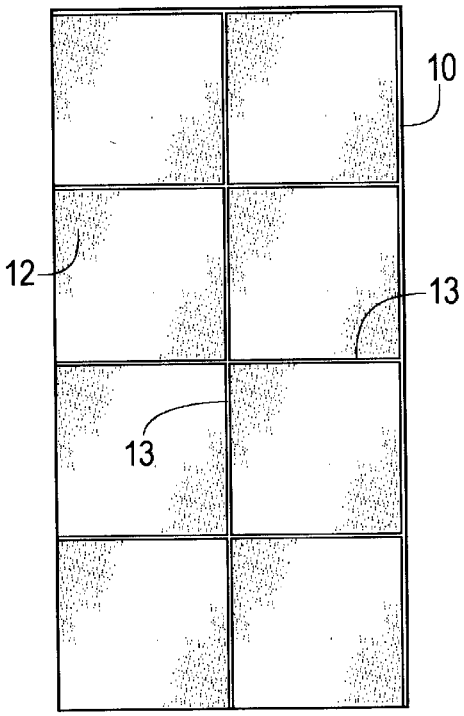
FIG. 1 is a perspective view of a cementitious building panel having a stucco appearance constructed in accordance with the present invention.

One example of a building panel that can be formed using the process of the present invention is illustrated in FIG. 1. More particularly, FIG. 1 illustrates a building panel 10 having a front face 12 formed to have a stucco appearance with a plurality of grid lines 13. Again, the building panel 10 is formed from a glass fibre reinforced cementitious mixture and has a dimension of approximately 4 ft.×8 ft. with a nominal thickness of approximately ⅞ inch to 1 inch.

Figure 2:
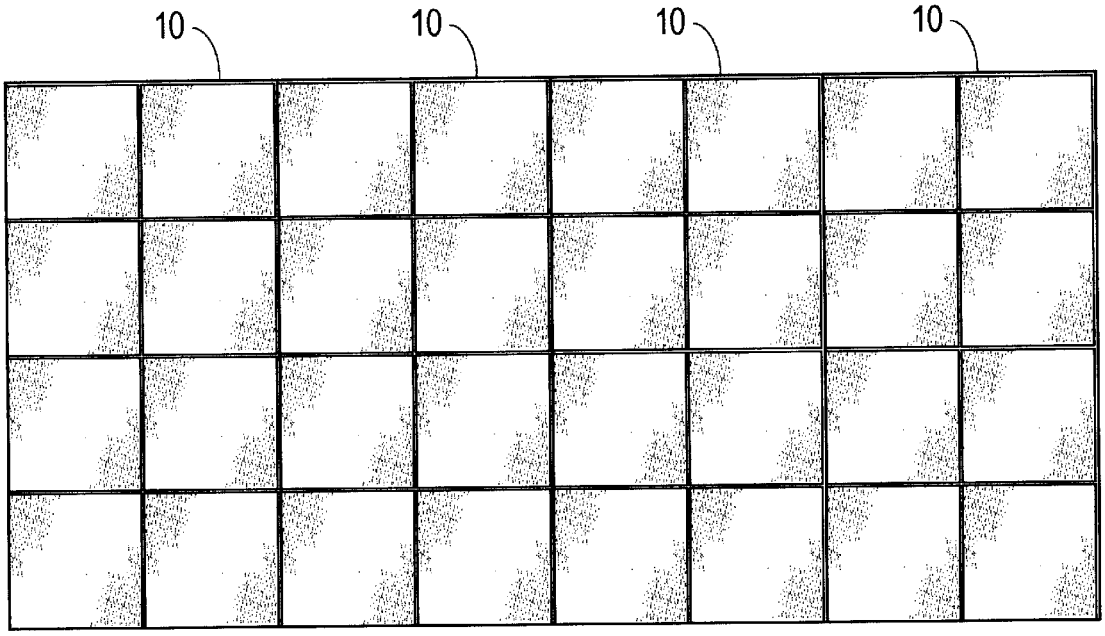
FIG. 2 is a plan view of an assembly of the cementitious building panels of FIG. 1.

FIG. 2 illustrates a plurality of the building panels 10 arranged in a side by side relation as if the building panels 10 were secured to a structure to form an exterior wall.

Figure 3:
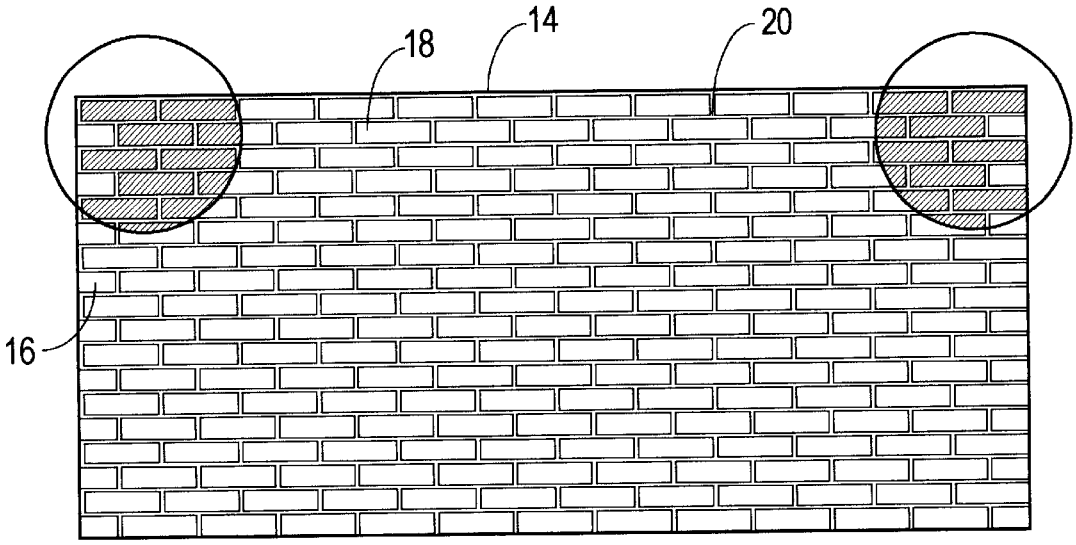
FIG. 3 is a another embodiment of a cementitious building panel having a brick appearance constructed in accordance with the present invention.

FIG. 3 shows another embodiment of a building panel 14 having a front face 16 formed to have a brick appearance. In other words, the front face 16 is formed to have a plurality of rectangularly shaped brick portions 18 separated from each other by a mortar joint portion 20. As illustrated within the circled areas of FIG. 3 and as will be described in greater detail below, the brick portions 18 are formed from a cementitious mixture having a color in contrast to the color of the cementitious mixture used to form the mortar joint portion 20.

Figure 1A:
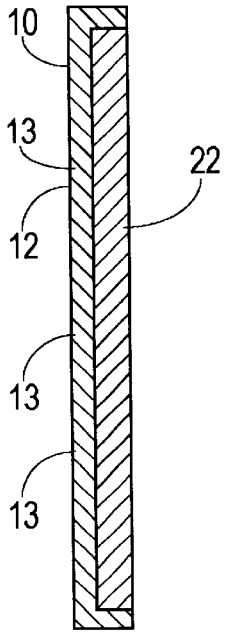
FIG. 1A is a sectional view taken at 1A—1A in FIG. 1.

The building panel 10 of FIG. 1 is further shown in FIG. 1A to include a backer 22. The backer 22 is a sheet of material placed in the cementitious mixture during the forming process so as to serve as a filler material and produce a building panel that is lighter in weight than a building panel formed of only cementitious material. In the past, the backer 22 has been fabricated of various types of foam materials, including expanded polystyrene foam, extruded polystyrene, and expanded urethane structural foam, as well as compressed wood fibre medium density wall sheathing board. The backer 22 may also be fabricated of an exterior grade gypsum sheeting. The use of the gypsum sheeting provides several advantages. Besides decreasing the weight of the building panel, the gypsum sheeting is fireproof and cost less than cementitious material. It should also be appreciated that the building panel 10 may be formed without the backer 22 whereby the building panel 10 is formed of a single material.

Figure 4:
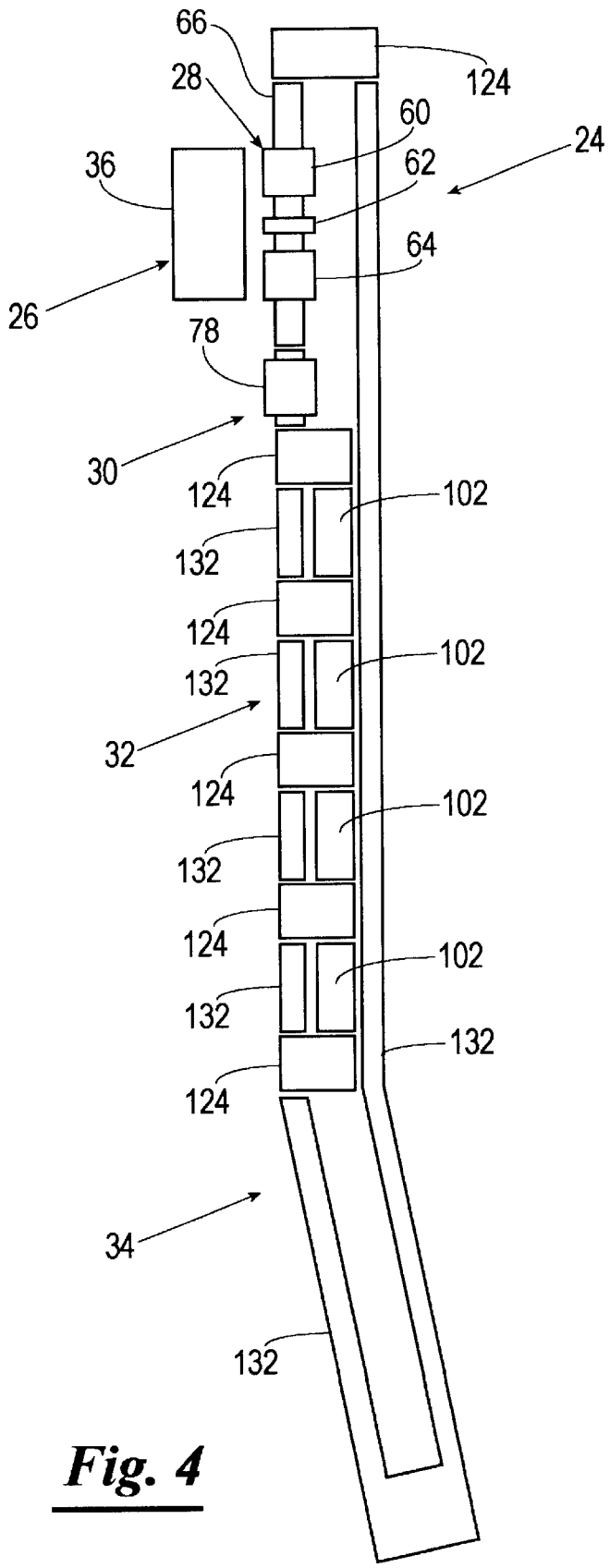
FIG. 4 is a schematic illustration of a process for forming the cementitious building panels such as those illustrated in FIGS. 1 and 3.

Referring now to FIG. 4, shown therein is a schematic illustration of an assembly line 24 constructed in accordance with the present invention for forming the cementitious building panels, such as those illustrated in FIGS. 1 and 3. The assembly line 24 provides a means to form building panels, both single color and multiple color, with and without backers, in a time and cost efficient manner.

In general, the assembly line 24 includes a mixing station 26, a pour station 28, a backer placement station 30, a cure station 32, and a removal station 34. The cementitious panels are formed by introducing a cementitious mixture produced at the mixing station 26 into a mold at the pour station 28. While the cementitious mixture can be hand mixed and in turn poured into the mold, it is preferable that the cementitious mixture be mixed in an automated batch mixing system 36. A suitable mixing system is commercially available from Nippon Electric Glass America, Inc., Hutchins, Tex.

A cementitious mixture suitable for use in the method of the present invention includes five principle ingredients, namely a cement mixture of Portland cement and a crystal modified Portland-type cement (i.e., a quick set cement), quartz aggregate, chopped fiberglass strands, and water. The crystal modified Portland-type cement together with the Portland cement makes possible quick setting of the cementitious mixture in the manner described hereinbelow while maintaining the workability of the cementitious mixture while the cementitious mixture is being introduced into the mold.

Figure 5:
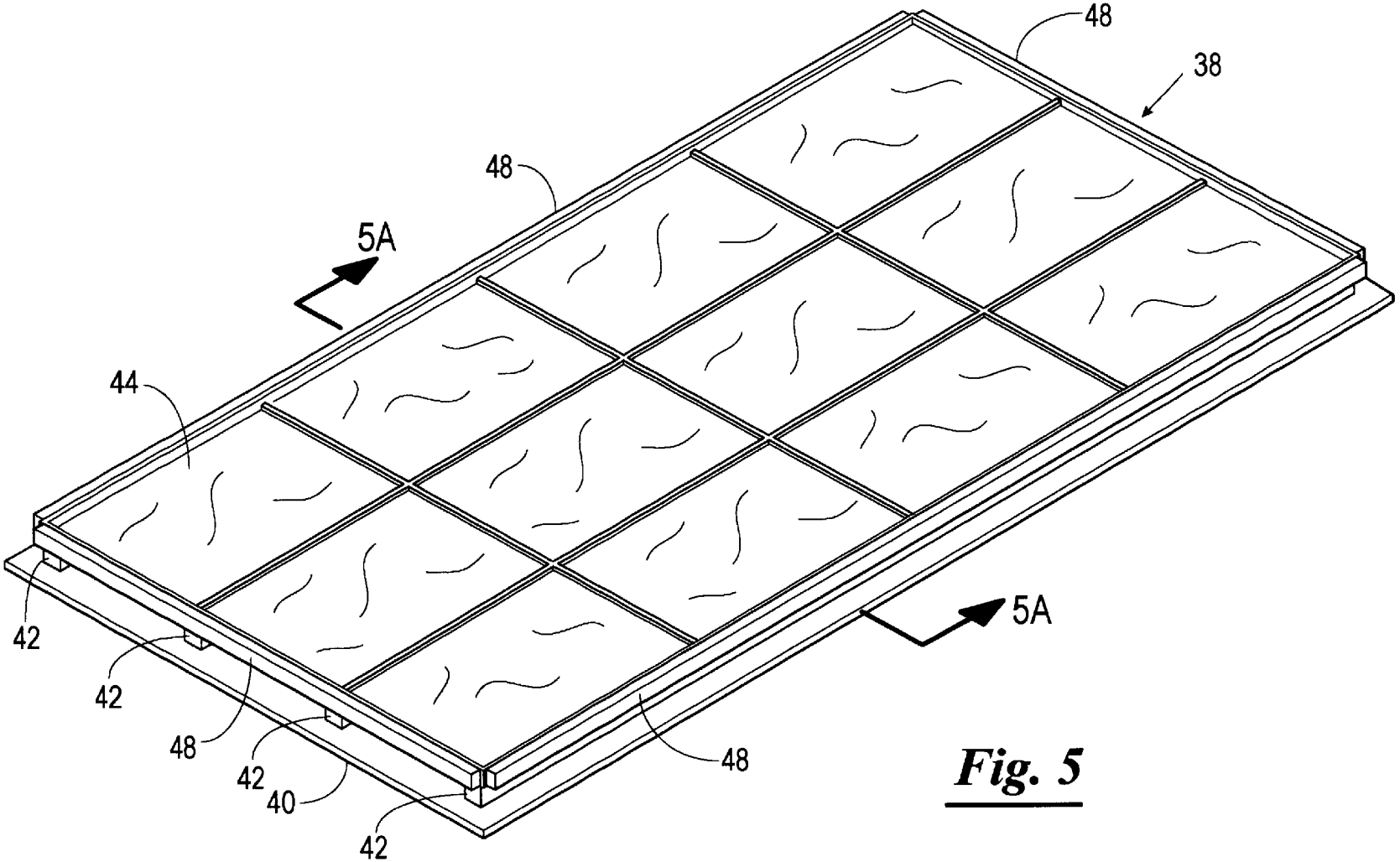
FIG. 5 is a perspective view of a mold used in forming cementitious panels.
Figure 5A:
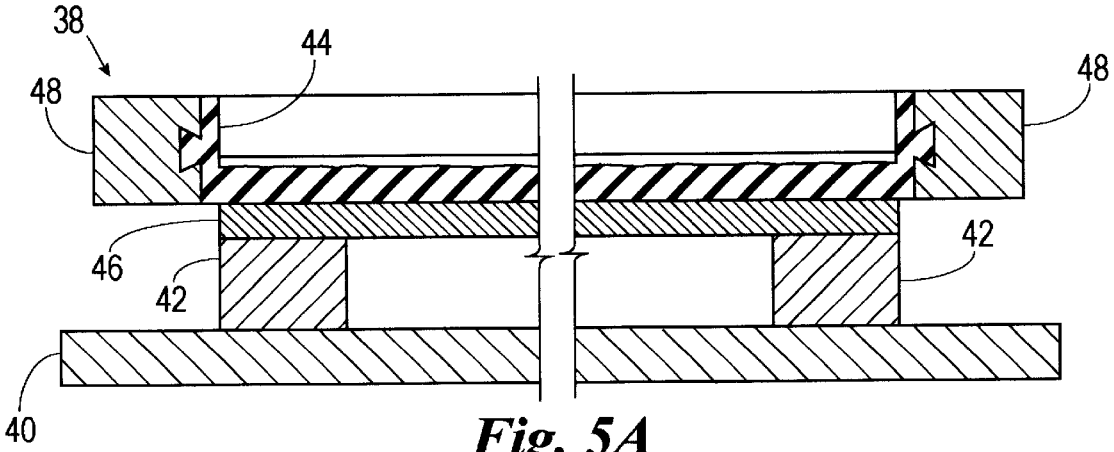
FIG. 5A is a cross-sectional view taken at 5A—5A in FIG. 5.

An example of a crystal modified Portland-type cement or quick set cement suitable for use in the method of the present invention is commercially available from Ultimax Cement Manufacturing Corporation of Huntington Beach, Calif. and is known as ULTIMAX Cement®. The amount of Portland cement and quick set cement may vary widely depending on atmospheric conditions at the time the cementitious mixture is introduced in the mold. For example, desirable results can be obtained when the cement mixture contains from about 25%–75% by weight Portland cement to quick set cement to about 60%–40% by weight Portland cement to quick set cement. Other ingredients may be added to the cement mixture in minor amounts, such as perlite, defoamers, polymers, and colorants. The amounts of the ingredients used, as well as other common cementitious ingredients, depends on the physical properties, such as compressive strength, desired for the final product. It will also be appreciated that the desired appearance of the final product is another factor that must be considered in the selection of ingredients, particularly in the selection of the aggregate and the chopped fiberglass strands. FIGS. 5 and 5A illustrate an example of a mold 38 used in forming the cementitious panel 10 described above. The mold 38 includes a rigid base plate 40, a plurality of cross members 42, a cast 44, a cast base 46 (FIG. 5A), a plurality of cast support rails 48. The base plate 40, the cross members 42 and the cast base 46 are preferably constructed of a non-metallic material, such as wood. The cast 44 is fabricated of an elastomeric material, such as polyurethane, and is configured to provide the desired surface appearance and profile of the cementitious panel. While it is desirable that the cast 44 not be rigid to facilitate removal of the formed cementitious panel, it is necessary to maintain overall dimensional accuracy, including edge straightness and panel thickness. This is achieved by bonding the cast 44 to the rigid cast support rails 48 and the rigid base plate 40. The cast support rails 48 support the edges of the cast 44 while the combination of the cast base 46, the cross members 42, and the base plate 40 support the bottom of the cast 44. The support rails 48 are spaced from the cast base 46 to permit the support rails 48 and the edges of the cast 44 to be flexed downward slightly with respect to the cast base 46 to facilitate removal of the formed cementitious panel. The rigidity provided by the base plate 40, the cross members 42 and the cast base 46 permit the mold 38 to be moved along the assembly line 24 without disturbing the cementitious panel being formed therein.

Figure 6A:
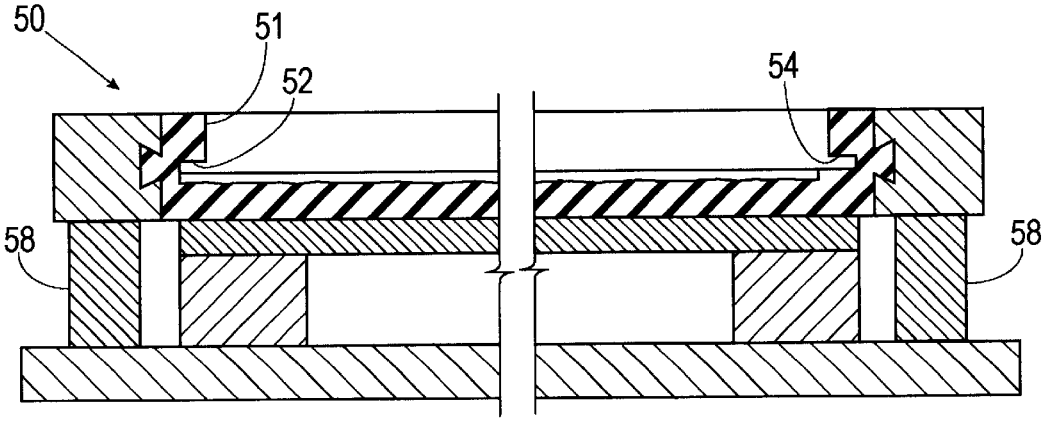
FIG. 6A is a sectional view of another mold constructed in accordance with the present invention for forming cementitious panels showing the edges of the mold in a forming position.
Figure 6B:
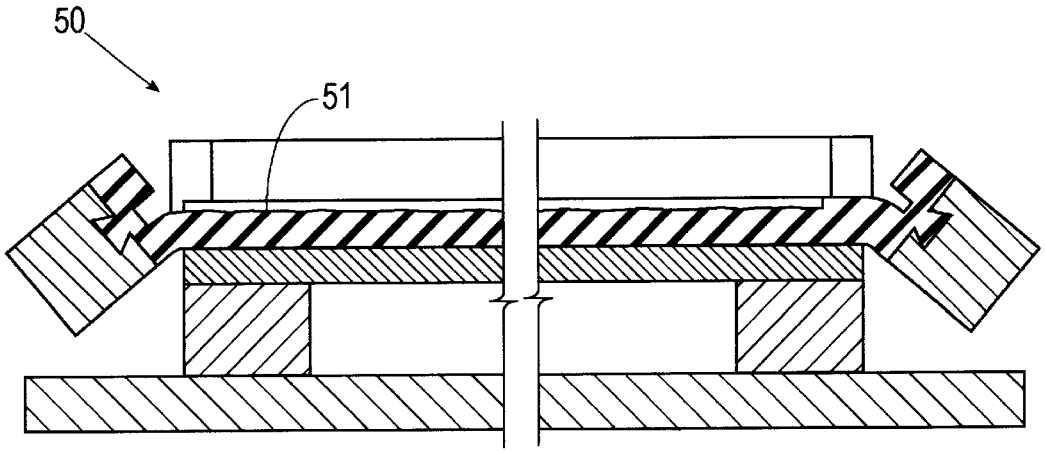
FIG. 6B is a sectional view of the mold of FIG. 6A showing the edges of the mold in a panel removal position.

FIGS. 6A and 6B illustrate another embodiment of a mold 50 used in forming a cementitious building panel 10*a* (FIGS. 15A and 15B) in accordance with the present invention. The mold 50 is substantially similar in construction to the mold 38 described above with the exception that the cast 51 of the mold 50 is configured to form a lip along the edge of the building panel so as to provide a recessed area between two adjoining building panels, as will be described in further detail below. As best shown in FIG. 6A, the edges of the cast 51 are formed to have a recess 52 and a recess 54. The recess 52 is formed on two adjacent edges of the cast and the recess 54 is formed on the remaining two edges.

Figure 6C:
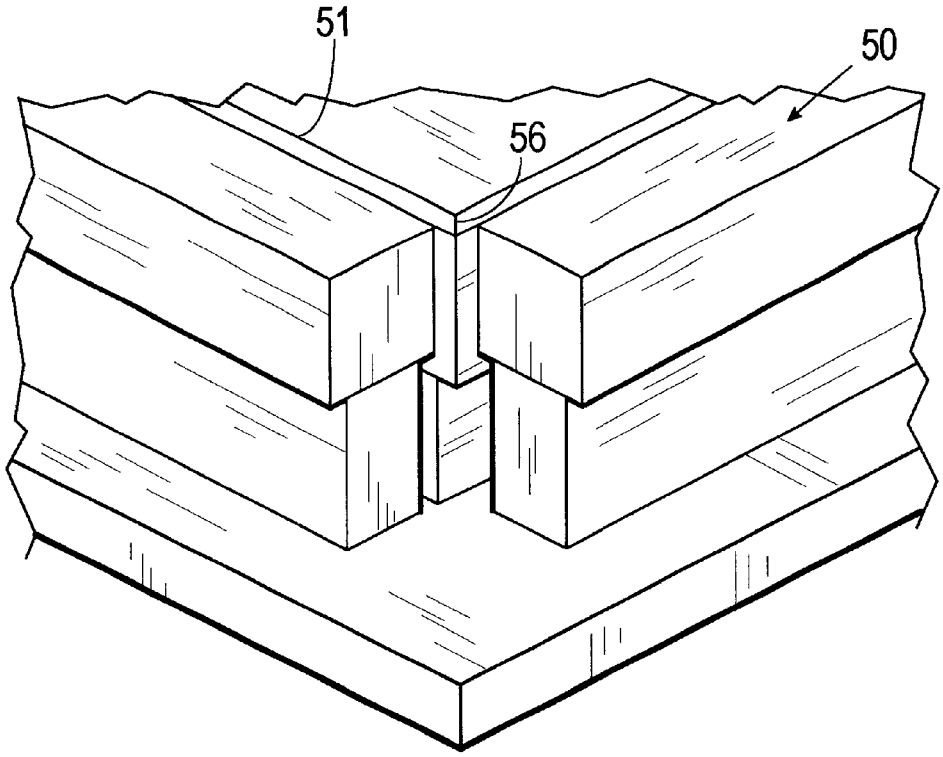
FIG. 6C is a fragmented, perspective view of one corner of the mold of FIG. 6A.

To enable the formed building panel to be removed from the mold 50 without breaking or damaging the lips formed on the building panel, the edges of the cast 51 of the mold 50 are constructed to be more flexible than the edges of the mold 40. This is accomplished by separating the edges of the cast 51 from each other generally along the area identified by the numeral 56 in FIG. 6C. During the process of forming a building panel in the mold 50, the edges may be supported by a spacer block 58 as illustrated in FIG. 6A. To remove the building panel from the mold 50, the spacer block 58 is removed thereby allowing the edges of the cast 51 to be flexed downwardly as shown in FIG. 6B.

Referring again to FIG. 4, the pour station 28 includes a first pour plate 60, a cavity filler unit 62, and a second pour plate 64 positioned in series with a powered conveyor 66 running between and beneath each of the first pour plate 60, the cavity filler unit 62, and the second pour plate 64.

The cavity filler unit 62 is utilized to fill brick face cavities provided in a mold configured to form a building panel having a brick appearance, such as the building panel 14 described above, with a cementitious mixture that is colored to resemble the color of a desired brick appearance. While these brick face cavities can be poured by hand, this is a slow and tedious task. The cavity filler unit 62 is adapted to automatically fill each of the brick face cavities with a selected amount of cementitious mixture as the mold is moved under the cavity filler unit 62 via the conveyor 66.

Figure 7:
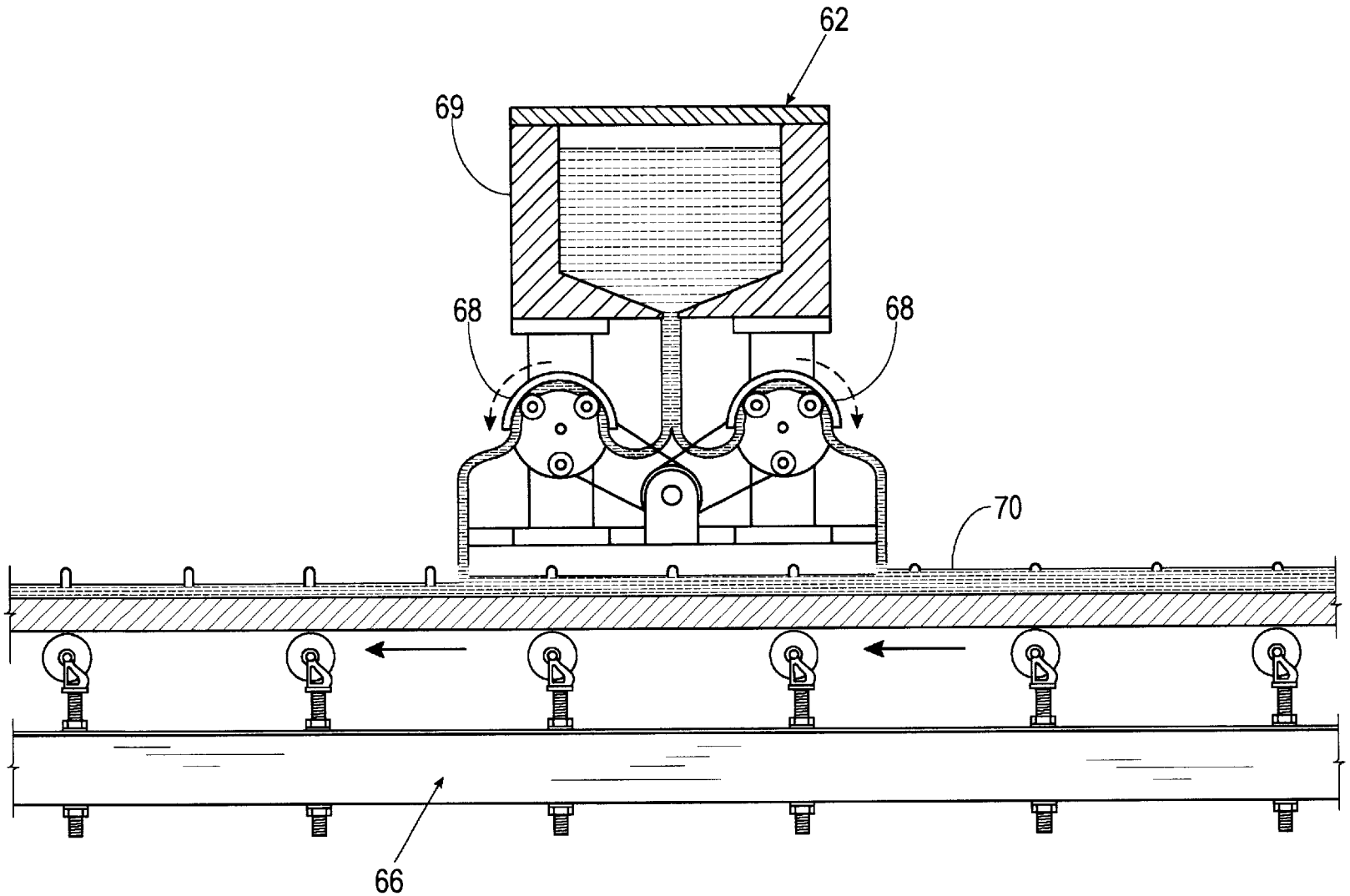
FIG. 7 is a partially cross sectional, side view of a mold cavity filler unit constructed in accordance with the present invention shown positioned above a mold.
Figure 8:
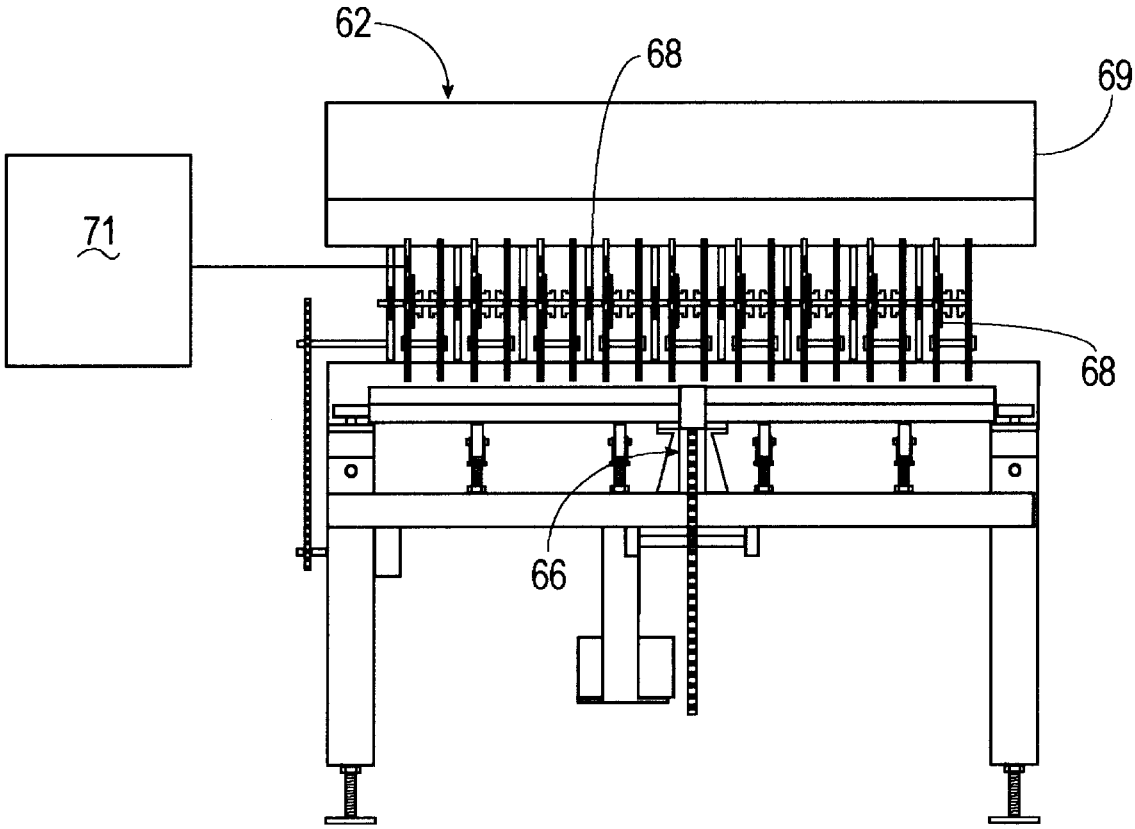
FIG. 8 is an end view of the mold cavity filler unit of FIG. 7.

As illustrated in FIGS. 7 and 8, the cavity filler unit 62 utilizes a series of peristaltic pumps 68 (one per row of horizontal bricks in a given mold pattern) to pump a cementitious mixture from a hopper 69 to the brick face cavities depicted by the numeral 70 in FIG. 7. The mold is moved under the peristaltic pumps 68 at a pre-determined rate of speed on the conveyor 66. The pumps 68 are driven at a speed controlled so as to pump the exact quantity of mixture needed to fill one brick face cavity during the time interval the brick face cavity is moving under the outlet of the pump.

Peristaltic pumps are used because of their simplicity, integrity of mixture (do not contaminate mixture as it passes through), pump volumetric accuracy per pump revolution interdependent of pump rotational speed, and ease of cleanup and pump maintenance.

The pumps 68 are arranged in a pair of parallel banks, each of which can be controlled (turned on or off) separately. Most brick is laid in a staggered pattern where each row is offset by one-half brick in relationship to the row above and below it (called "running bond pattern"). The other popular pattern is called "stacked bond" where the bricks are arranged in vertical columns, one directly above the other.

By controlling the on-off timing of the two banks of pumps 68, it is possible to sequence the pumps to fill either type of brick pattern. Control can be accomplished by electromechanical switching which is synchronized to the movement of the mold as it travels beneath the cavity filler unit 62. However, it is best controlled by a computer 71 which has sensors which tell it when each mold has moved into the filling position on the conveyor line below the cavity filler unit 62 and then sequences the pumps 68 as required to fill the mold.

Another advantage of the computer control is the ability it provides to produce multicolor (or blended color) brick panels. However, it is imperative that when utilizing factory produced panels that the color patterns within any given panel be uniquely different from any other adjoining or nearby panel in order to avoid creating a "checkerboard patterning" effect.

The blend of brick colors is created by adding a separate bank of pumps to the cavity filler unit 62 for each different desired color of brick. Each pump has a separate clutch which will engage or disengage it to the common drive shafts of the pump bank. The computer 71 is programmed to select which pumps in which color banks are turned on to create the desired color mixture within a given pattern (that is, will determine the portion or percentage of each color to be used in each panel) . It also determines the color pattern within each panel so that each panel has its own distinctive pattern. Since the computer can literally produce thousands of color patterns without duplication, it would be virtually impossible for identical color patterns to ever be installed side-by-side thus avoiding the "checkerboard pattern effect".

After the brick face cavities have been filled, the remainder of the mold is filled with a cementitious mixture that is distinctive in color from the cementitious mixture introduced into the brick face cavities so as to produce the mortar joint portion and form the balance of the building panel. This requires that a second pour of cementitious mixture be made. However, it is critical that the second pour be made so as not to disturb the first pour and while each of the cementitious mixtures are still in a liquid state so that their adjacent surfaces are able to commingle or blend together, thus avoiding the formation of a "cold joint" between the two mixtures. Each of these aims is accomplished with the use of the second pour plate 64. The second pour plate 64 is constructed to receive the second cementitious mixture from the mixing station 26 and deposit the second cementitious mixture in a uniform thickness from a lower end of the pour plate 64 into the mold and on top of the first cementitious mixture. The mold is moved under the second pour plate 64 with the conveyor 66. In addition, the cementitious mixture is discharged from the pour plate 64 at the same rate at which the mold is moved past the second pour plate 64, thereby resulting in the second cementitious mixture being deposited onto the first cementitious mixture at substantially zero velocity so that the second cementitious mixture does not disturb the first cementitious mixture.

Figure 9:
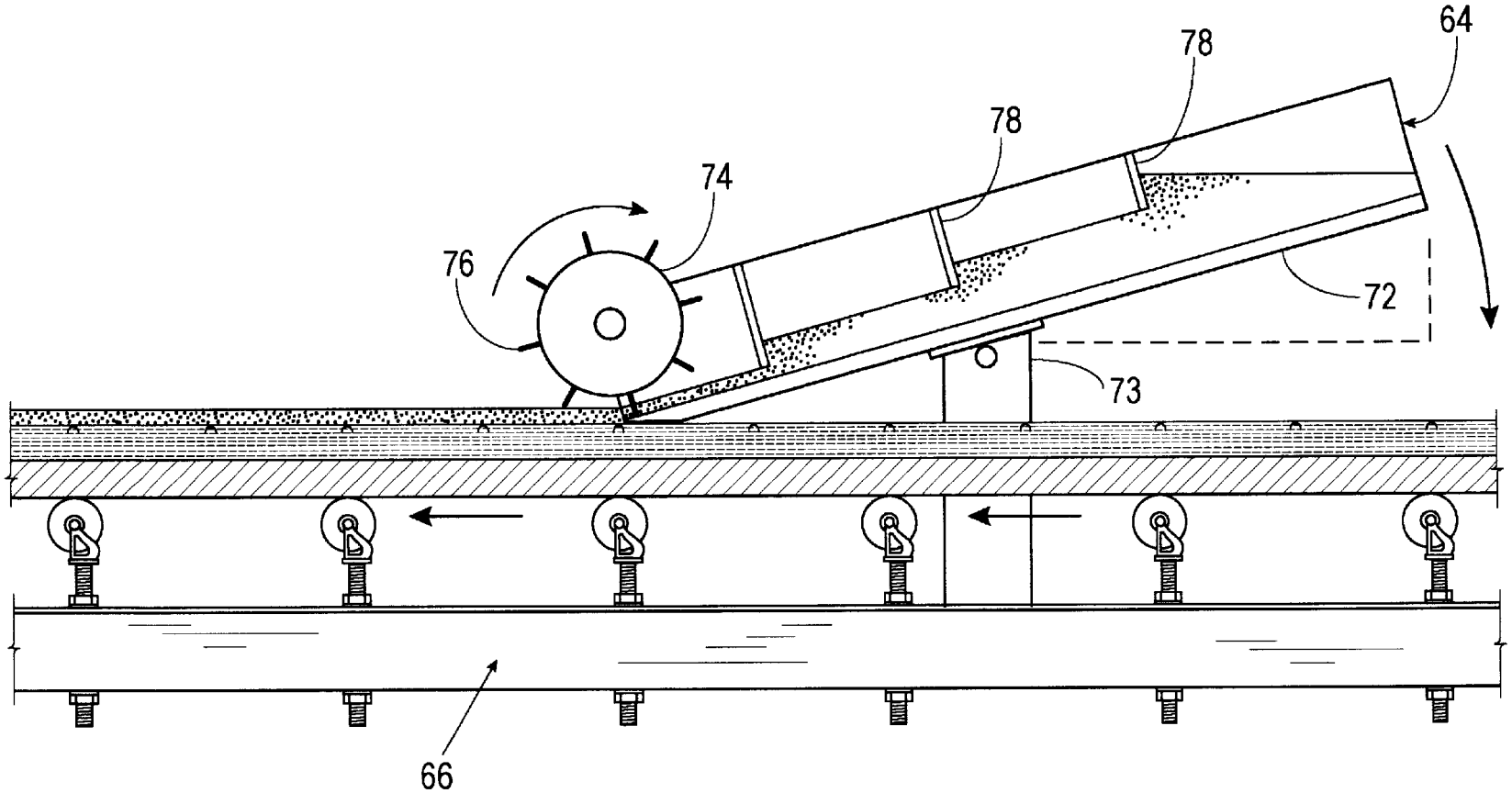
FIG. 9 is a side view of a pour plate constructed in accordance with the present invention.

As shown in FIG. 9, the second pour plate 64 includes a basin 72 pivotally supported above the conveyor 66 by a pair of support members 73. One end of the basin 72 is open. This open end is provided with a cylinder 74 having a plurality of conveyor blades 76 arranged thereon to sweep a layer of cementitious mixture out of the basin 72 and off its lower edge onto the mold. The cylinder 74 is driven by a motor (not shown) at exactly the same speed as the mold is moving under the pour plate 64. The result, as mentioned above, is that the cementitious mixture is laid on top of the first cementitious mixture in the brick face cavities at substantially zero velocity and therefore does not disturb nor displace the cementitious mixture in the brick face cavities. The pour plate 64 may include a plurality of adjustable dams 78 positioned in the basin 70 for controlling the flow of the cementitious mixture from the pour plate 64.

In the instances when a cementitious panel is formed from single colored cementitious mixture, use of the cavity filler unit 62 is not required. As such, the second pour plate 64 is utilized to introduce all the cementitious mixture into the mold in the same manner as that the second cementitious mixture is introduced onto the first cementitious mixture.

In other instances, it may be desirable to form a building panel from two different cementitious mixtures. More specifically, in certain applications where a smooth finish is required, a glass fibre reinforced cementitious mixture does not produce the desired surface finish. As such, a thin layer of cementitious material that does not have glass fibre is first introduced into a mold via the first pour plate 60 in a manner similar to that described above in reference to use of the second pour plate 64. The mold is then conveyed past the cavity filler unit 62 and under the second pour plate 64 where the balance of the mold is filled with a glass fibre reinforced cementitious mixture. It should be understood that the first pour plate 60 is identical in construction to the second pour plate 64.

Figure 10:
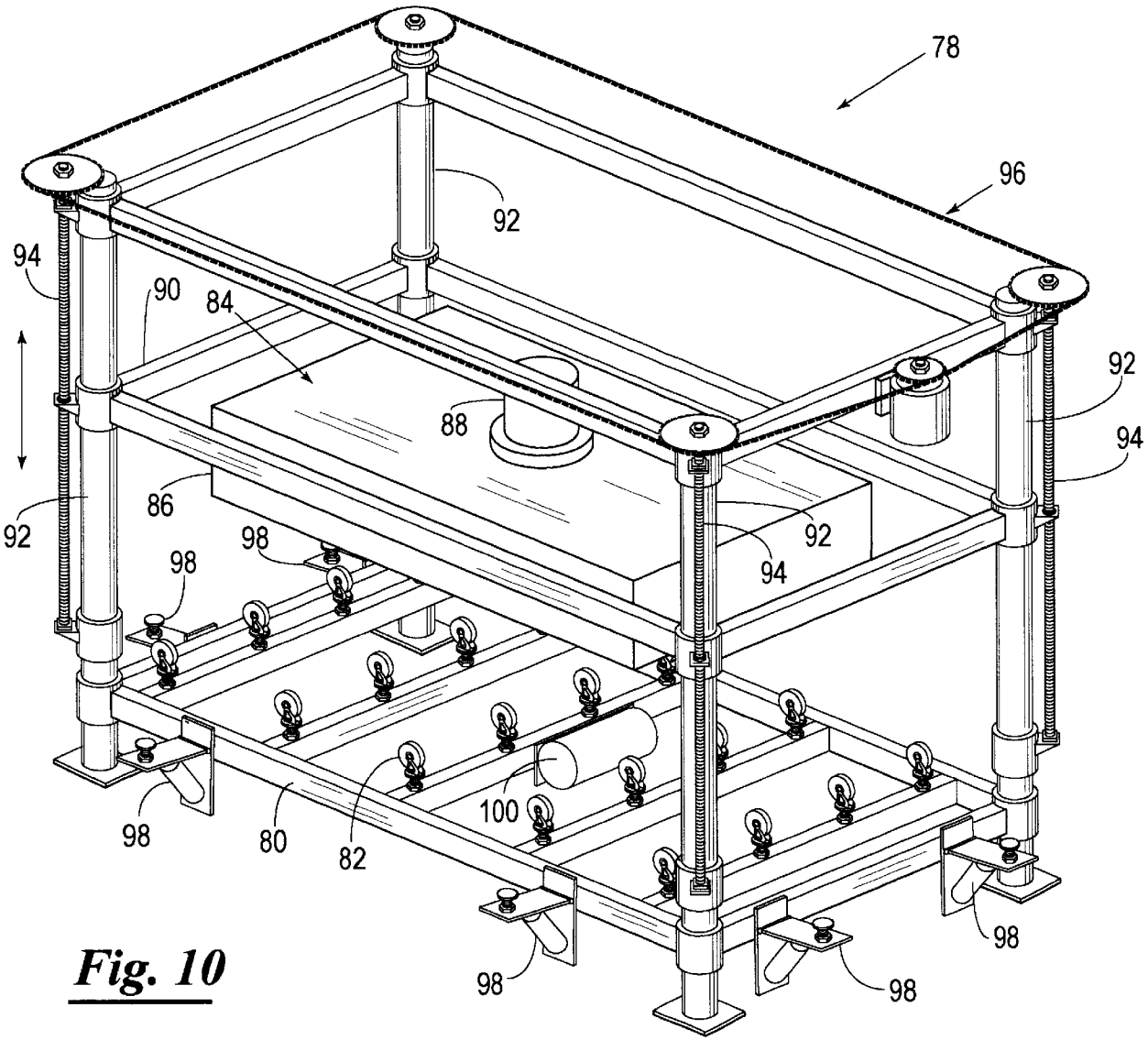
FIG. 10 is a perspective view of a backing placement unit constructed in accordance with the present invention.

After the cementitious mixture has been introduced into the mold, the mold may be transferred to the backer placement station 30. The backer placement station 30 includes a backer placement unit 78. As illustrated in FIG. 10, the backer placement unit 78 comprises a frame 80, a roller wheel conveyor 82, and a vacuum assembly 84 supported above the roller wheel conveyor 82. The vacuum assembly 84 includes a vacuum frame 86 which is a rectangular box structure with an open bottom. A vacuum pump 88 is connected to the upper side of the vacuum frame 86 for producing a vacuum in the vacuum frame 86. The vacuum assembly further includes a support frame 90 connected to the vacuum frame 86 and slidably connected to a plurality of vertical supports 92 of the frame 80 such that the vacuum assembly 84 is movable between an up position and a down position on the frame 80. The vacuum assembly 84 is moved via a plurality of drive screws 94 threadingly engaged with the support frame 90 and a sprocket and chain drive assembly 96.

In those instances when a backer is to be inserted into the mold, air actuated clamps 98 center the mold below the vacuum frame 86. However, previous to the filled mold being moved into the backer placement unit 78, a stack of backers which have been placed on a base the same size as a mold is rolled into the backer placement unit 78 and clamped into position. The stack of backers is located on the base in exactly the position the backer is to occupy in the finished panel. The vacuum frame 86 is lowered to contact the top backer, the vacuum pump 88 is turned on, and the vacuum frame 86 with the backer now held in place by the vacuum, is then raised. The base with the remaining backers is then removed from the backer placement unit 78 and the filled mold moved into the backer placement unit 78 and clamped into position.

The vacuum frame 86 (with backer) is then lowered into position, placing the backer into the proper location in the mold. The downward movement of the backer causes the cementitious mixture in the mold to move outward to fill the mold to the top of the mold edges and level with the top of the backer.

With the backer positioned in the cementitious mixture, it is next necessary to remove any air entrapped between the cementitious mixture and the backer. Some backers (such as most structural foams and compressed wood fibre sheathing) allow the vacuum to pull any air trapped between the backer and the mixture up through the backer, thus eliminating any significant air pockets. On nonporous backers such as exterior gypsum board, a pattern of small vent holes must first be drilled through the backer. These are sufficient to draw out entrapped air but do not allow sufficient airflow so as to prevent the vacuum from holding the backer securely in place.

Once any excess mixture squeezed out of the mold by the backer has been cleaned up, the vacuum is turned off, the vacuum frame 86 raised, the mold positioning clamps 98 released, and the mold rolled out of the backer placement unit 78.

In those instances when a backer is not to be positioned in the cementitious mixture, the backer placement unit 78 is provided with a vibrator 100 for vibrating the frame 80 and in turn the filled mold to release air entrapped in the cementitious mixture.

From the backer placement station 30, the mold is moved to the cure station 32. Cementitious mixtures cure through a chemical reaction between the cement components of the mixture. The mixture first goes into a jell state and then on into the final solid crystalline state. This reaction is exothermic but starts off rather slowly.

It has been found that by subjecting the mixture in the mold to ultra high frequency electromagnetic waves (commonly known as microwaves), the molecules can be excited within a span of a few minutes (approximately six to twenty minutes) to raise the temperature of the mixture sufficient to accelerate the cure process where the exothermic reaction of the mixture is self-sustaining. After heating the mixture, the molds are allowed to remain on the conveyor line until approximately 30 minutes have elapsed, when the part is then ready for removal. The result is the reduction of the pour-to-part removal from the typical 8 hours to approximately 40 minutes.

Figure 11:
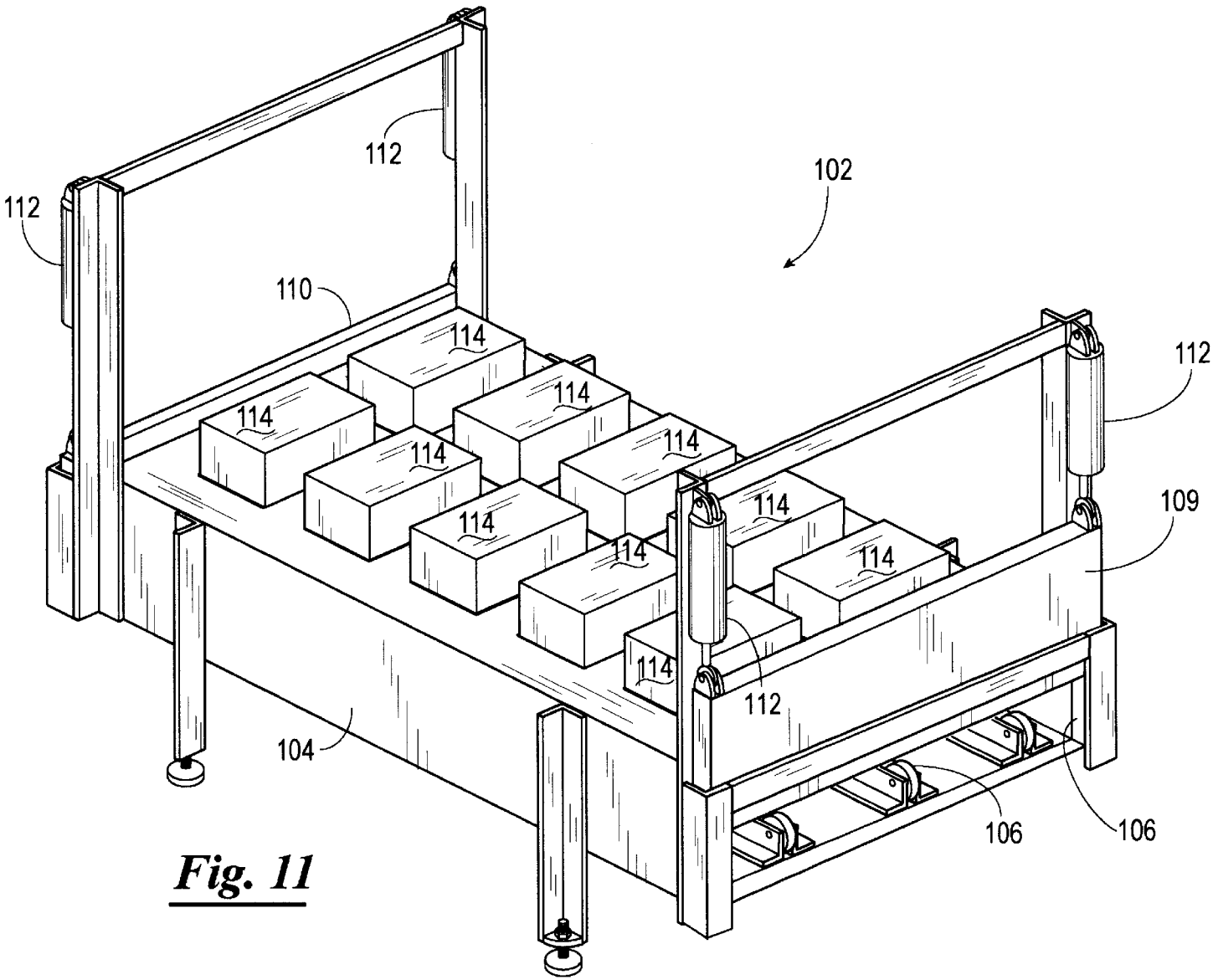
FIG. 11 is a perspective view of a molecular exciter unit for use in the process of forming the cementitious panels.

The cure station 32 preferably comprises a plurality of molecular exciter units 102. FIG. 11 illustrates the construction of one of the molecular exciter units 102, which includes a sheet metal rectangular housing 104 with a roller wheel conveyor 106. The filled mold is rolled into the molecular exciter unit 102 through a door opening 108 on one end thereof. A door 109, as well as a door 110, are then lowered into the closed position by air clamps 112 actuated to close and seal against any leakage of the ultra high frequency electromagnetic energy.

Figure 11A:
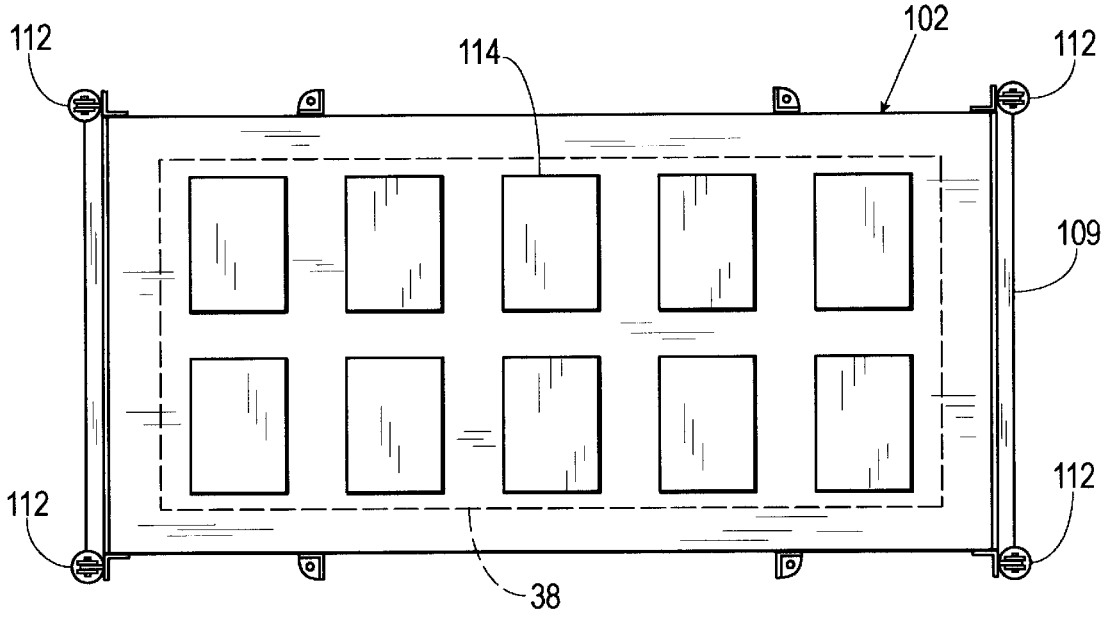
FIG. 11A is a top plan view of the molecular exciter unit of FIG. 11 with a cementitious mixture filled mold shown disposed withing the molecular exciter unit in phantom.

The molecular exciter unit 102 further includes a plurality of microwave energy producing units 114, such as a plurality of magnetrons or a plurality of commercial grade microwave oven units, mounted to the upper side of the housing 104 such that the microwave energy produced by each of the microwave producing units 114 is directed downwardly into the housing 104. In addition, the microwave energy producing units 114 are arranged on the upper side of the housing 104 such that the outer edges of the mold, such as mold 38, extends beyond outer edges of the collective microwave energy producing units 114, as illustrated in FIG. 11A. The microwave energy producing units 114 are used to generate the energy which induces the accelerated cure. The microwave energy producing units 114 are preferably interconnected to work in unison off common controls.

Once the mold with the formed building panel has been removed from the molecular exciter unit 102, an insulating blanket (not shown) is placed on top of the mold to retain the heat that the part is now self-generating. After a dwell time of approximately 20 to 30 minutes has elapsed, the formed building panel is removed from the mold with a vacuum removal unit 115.

Figure 12:
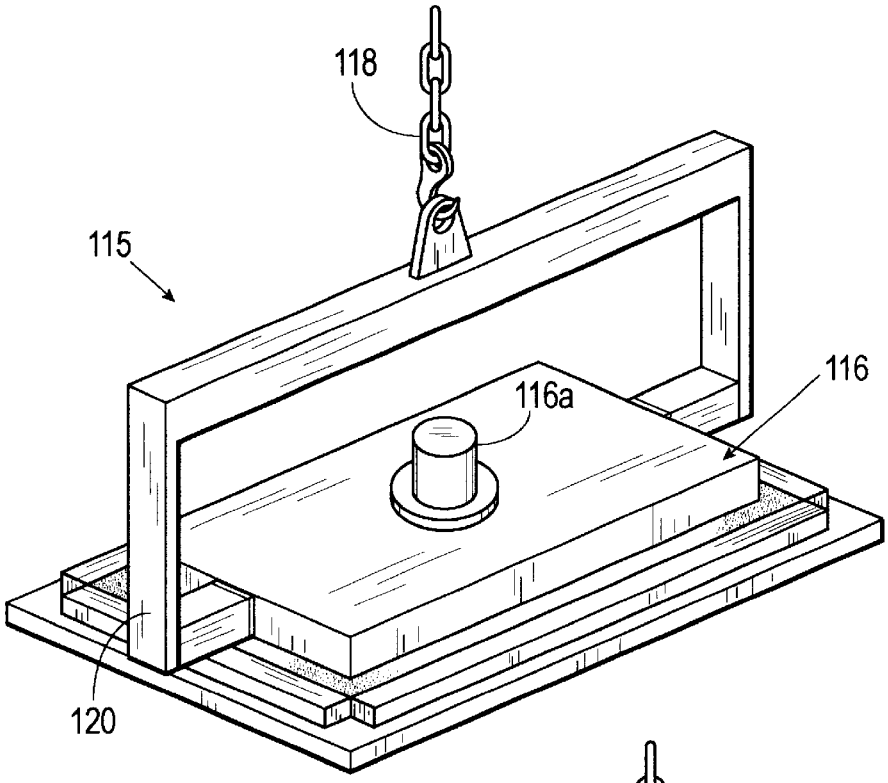
FIG. 12 is a perspective view of a vacuum removal unit shown positioned on a cementitious panel for removing the cementitious panel from the mold.
Figure 12A:
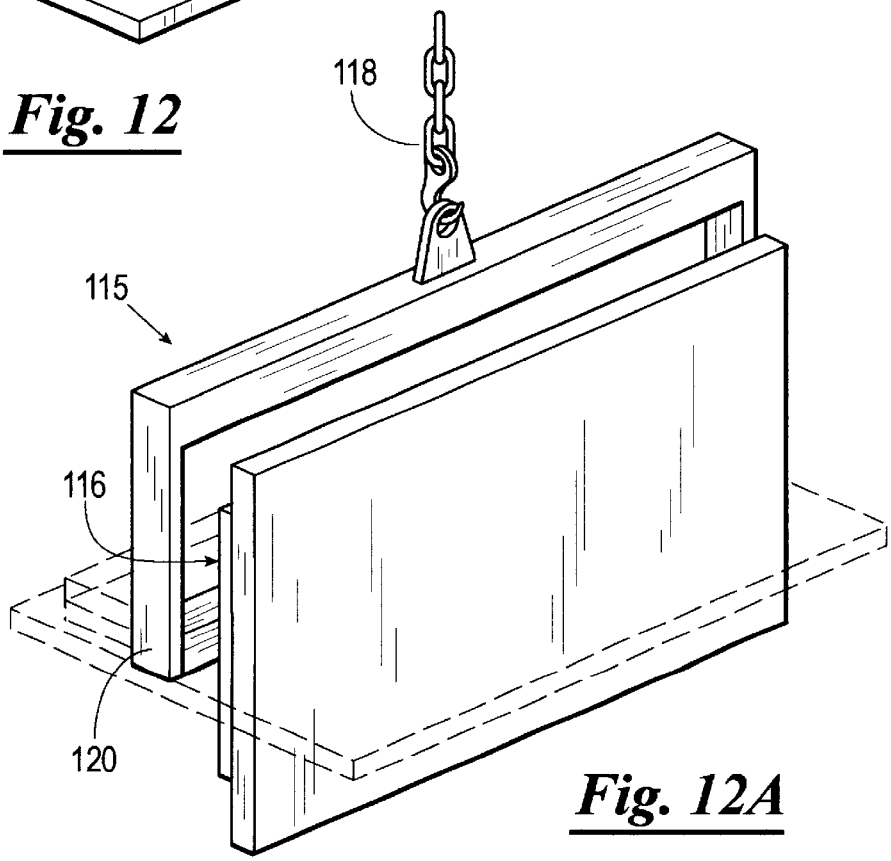
FIG. 12A is a perspective view showing the vacuum removal unit and the attached cementitious panel rotated to a vertical position.
Figure 13:
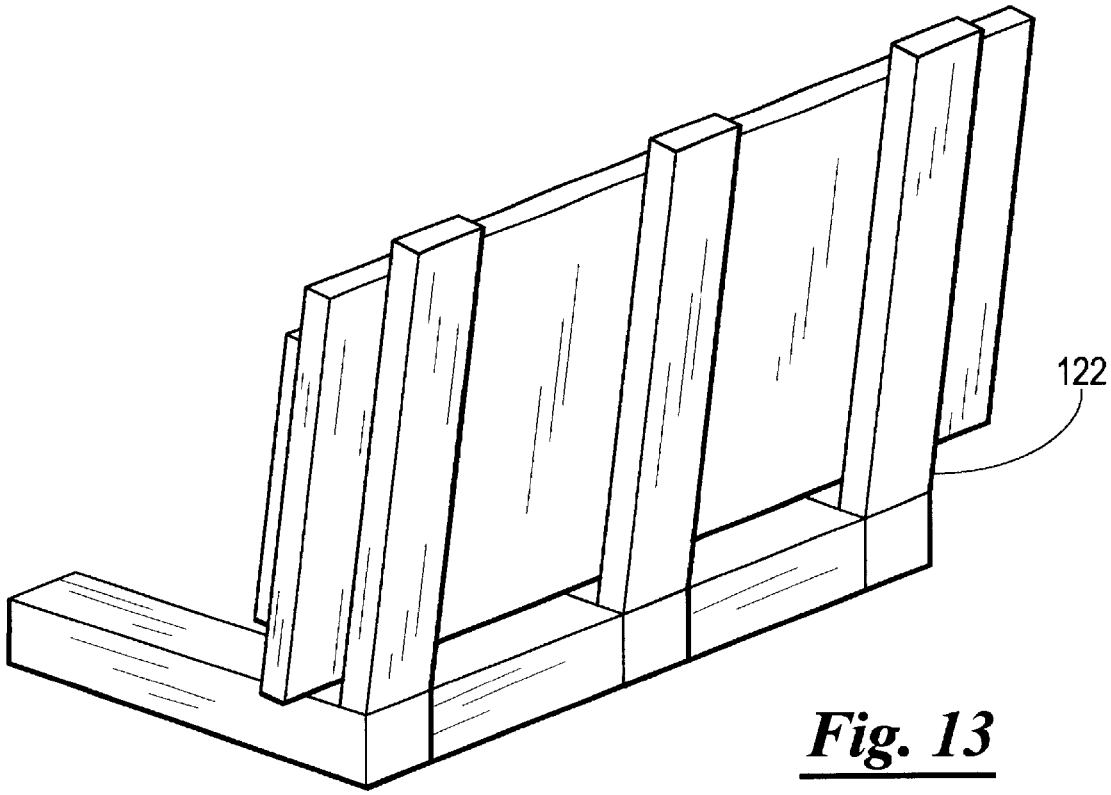
FIG. 13 is a perspective view of a panel drying rack.

As shown in FIG. 12, the vacuum removal unit 115 comprises a vacuum frame 116 and vacuum pump 116*a* similar to the one on the backer placement unit 78. The vacuum frame 116 is lowered into contact with the back of the building panel in the mold. When employing the mold 50 illustrated in FIGS. 6A and 6B, the edges of the mold 50 are pressed downward as shown in FIG. 6B causing them to move outward from the edges of the panel and freeing the undercut portions from the building panel. The vacuum is turned on and a hoist 118 lifts the vacuum frame 116 and the building panel free of the mold. A gimbal support 120 of the vacuum frame 116 then allows the building panel to be turned from a horizontal position (FIG. 12) to a vertical position (FIG. 12A) for inspection and the application of a seal coat to seal the pores of the cementitious surface. At this stage, the panel is quite warm (about 130° F. to 140° F.) as it comes from the mold. This flashes off the sealer within a few minutes. The vacuum frame 116 and the hoist 118 is then rolled along an overhead rail with the panel and vacuum frame 116 kept in the vertical position to a storage rack 122 (FIG. 13) in which the panel is lowered for storage and completed cure of the cementitious panel (concrete requires approximately 28 days for complete curing).

The weight of the filled molds is typically three to four hundred pounds or more. While the filled molds can be readily moved on standard roller conveyors, such conveyors leave much to be desired when it is necessary to move molds in a different direction using the minimum of conveyor space, oscillate the mold direction using the minimum of conveyor space and oscillate the mold on the conveyor. In addition, standard roller conveyors present a definite barrier to operating personnel who have need to move through to the other side of the conveyor line.

Figure 14A:
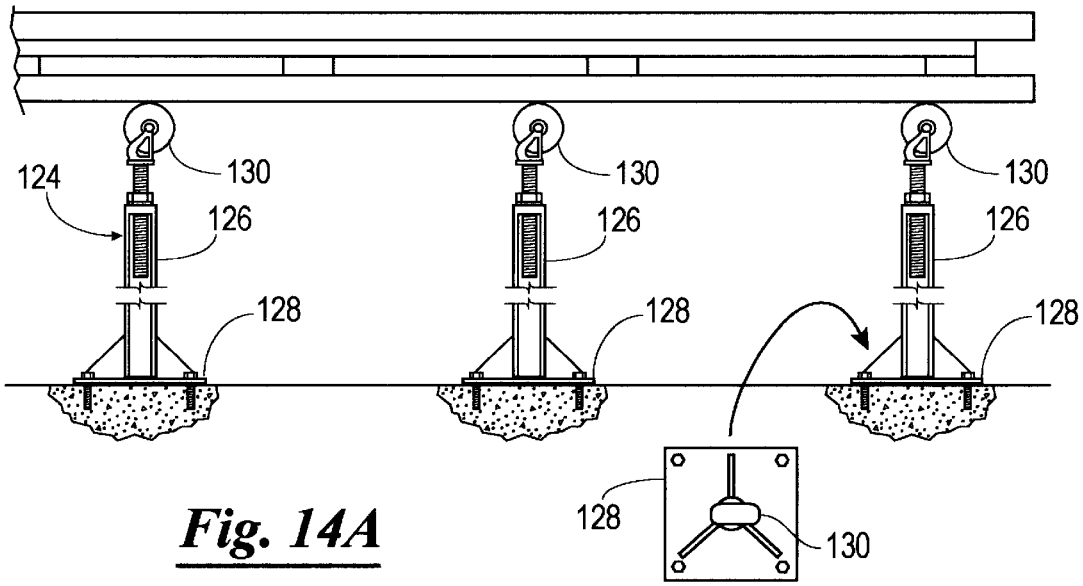
FIG. 14A is a side view of the mold supported on a omnidirectional conveyor system constructed in accordance with the present invention.
Figure 14B:
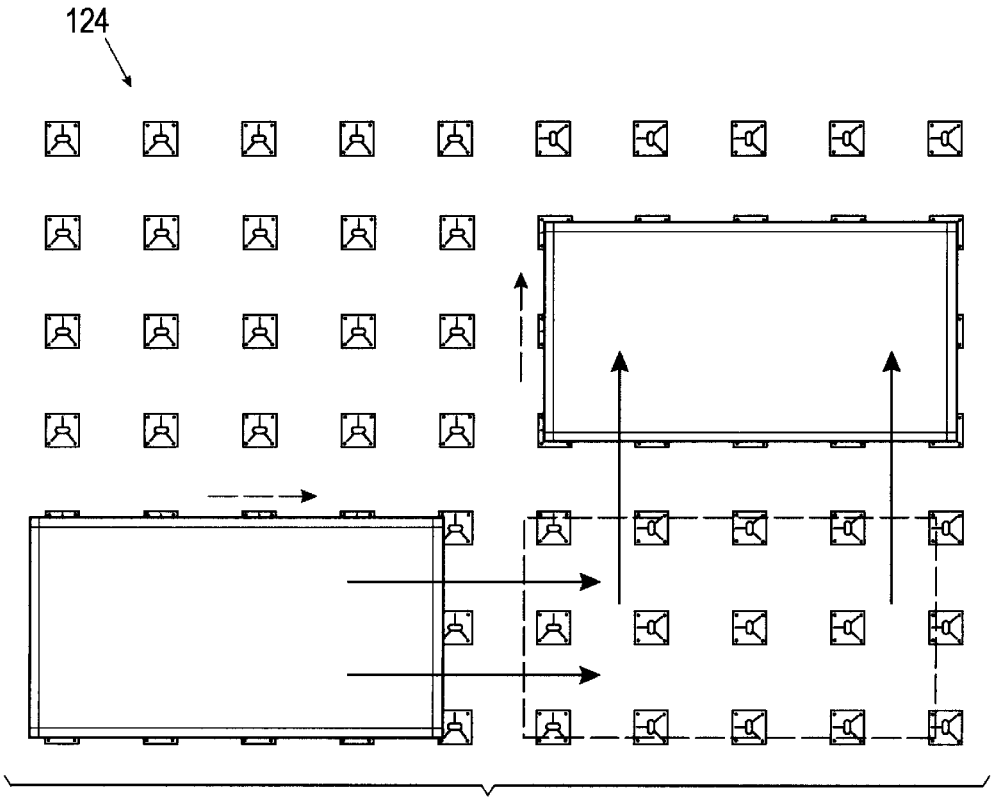
FIG. 14B is a top view illustrating movement of the mold over the omni-directional conveyor system.

These problems with standard roller conveyors are overcome with the use of an omni directional conveyor 124 as shown in FIGS. 14A and 14B. The conveyor 124 consists of a series of vertical posts 126 with a base plate 128 fastened to the floor in spaced apart relation. The upper end has a swivel caster 130 set into the upper end of an adjustable threaded shaft secured with a locknut. The overall height of the caster can be adjusted with the threaded shaft and locked into place with the locknut.

Heights can be adjusted so that the conveyor line is either at the same level, or can be adjusted to give the line a pitch to allow gravity movement of the molds. Also mold direction can be turned at any point (moved at 90 or any other angle, mold turned 180 degrees in their own length, conveyor made to curve).

The posts 126 are typically set on 20 inch to 24 inch centers which allows persons of normal size to readily move through the conveyor line at any point.

Referring again to FIG. 4, the assembly line 24 is shown to include a variety of conveyors for transporting the mold during the panel forming process. First, as mentioned above, the assembly line 24 includes the powered conveyor 66 for moving a mold through the pour station 28. Next, the assembly line 24 has a series of standard roller conveyors 132 for moving the molds in a to and fro direction. Finally, the assembly line 24 includes a series of the omni directional conveyors 124 shown in FIGS. 14A and 14B for occasions when it is necessary to change the direction of movement of the molds, such as when moving the molds from the backer placement unit 78 to one of the molecular exciter units 102.

The cementitious building panels described herein are not designed for, nor considered load bearing as far as vertical loads such as roof loads are concerned. They are designed as exterior paneling which is attached to the wall framing and are designed to take horizontal loads such as positive and negative wind pressure.

Figure 15A:
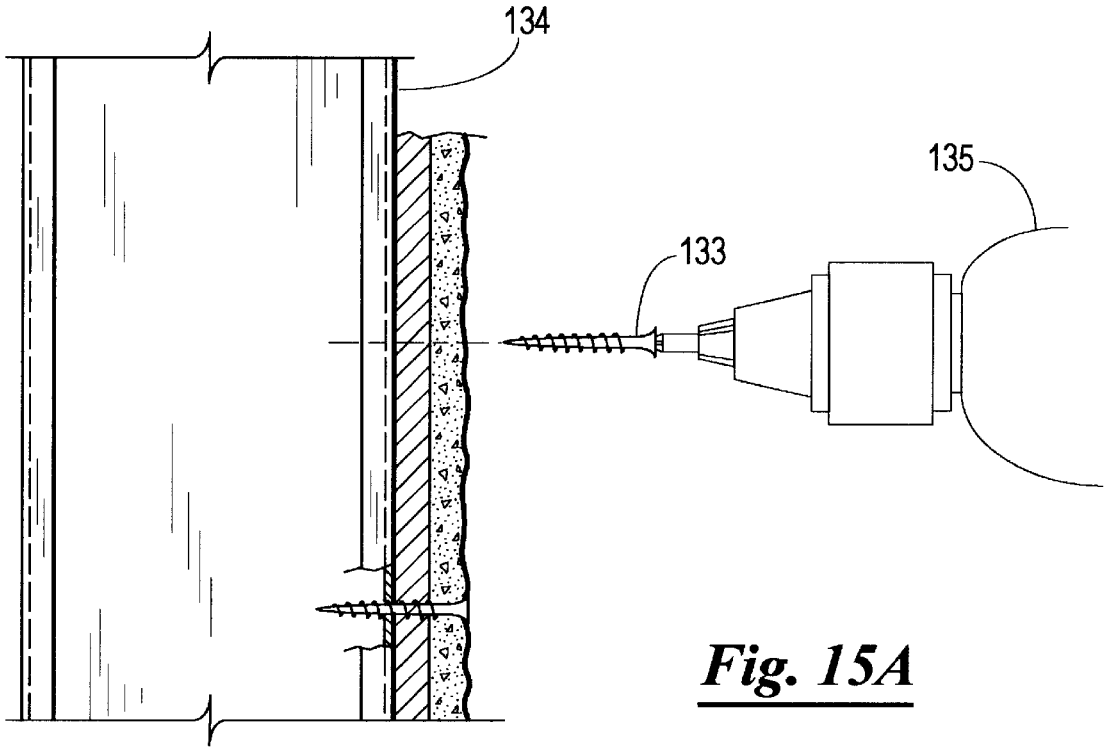
FIG. 15A is a perspective view of a cementitious building panel being secured to a wall stud with a screw.
Figure 15B:
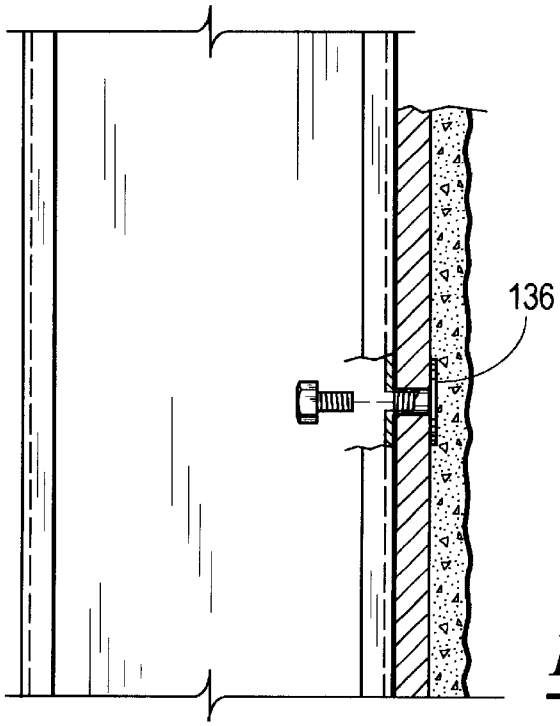
FIG. 15B sectional view of a cementitious building panel constructed in accordance with the present invention having an embedded fastener.

Two methods of fastening the building panels to a wall framing are illustrated in FIGS. 15A and 15B. The first method uses self-drilling, self-countersinking screws 133. A panel is placed into position against a wall framing 134 and the screws 133 installed using a standard screw gun 135 with adjustable clutch.

The screw self-drills 132 through the building panel and into the steel stud member. The screw head is designed to self-countersink (head has small ribs on the underside) and the screw gun clutch is set to stop the screw when it is just below the surface of the panel.

The screw head is then touched over with a urethane caulk, thus embedding the head and concealing it from view.

The second fastening method involves using embedded fasteners 136 which are placed in holes drilled at selected locations in the backer prior to the backer being placed into the mold with the cementitious mixture. These are used only with the more rigid backers such as the exterior gypsum sheathing.

The embedded fasteners 136 must be pre-located to where they will be properly positioned in relationship to the wall framing members. They are primarily used on panelized factory-built wall sections where framing member locations can be accurately predetermined.

Figure 16A:
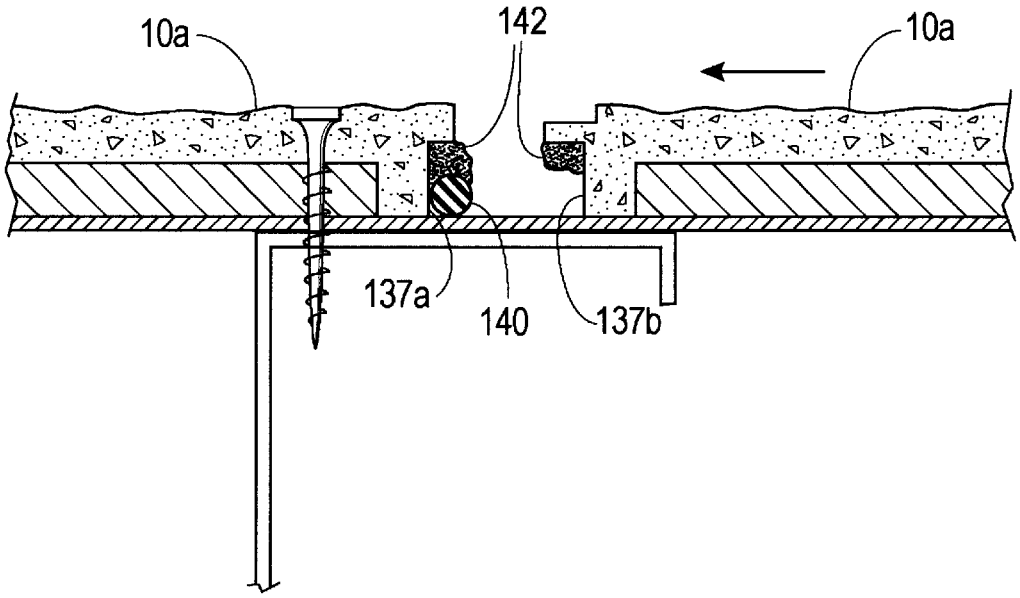
FIG. 16A is a sectional view of a pair of adjacent cementitious building panels constructed in accordance with the present invention illustrating the process of forming a sealed joint between the panels.
Figure 16B:
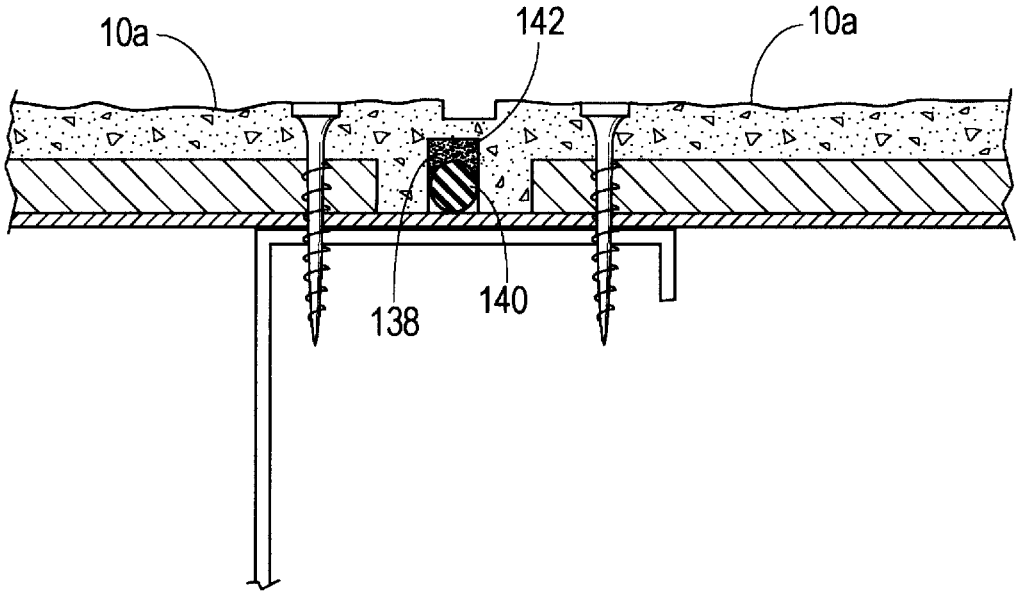
FIG. 16B is a sectional view of the cementitious building panels of FIG. 16A illustrating the sealed joint formed therebetween.

From a marketing standpoint, it is highly desirable that the assemblage of panels on a building wall not define the individual panels by way of a visible joint between the panels. However, it is also important that the panels have a weatherproof seal between their adjoining edges. FIGS. 16A and 16B illustrate how this is achieved with cementitious building panels formed with the mold 50 illustrated in FIGS. 6A, 6B, and 6C.

A recess 137*a* and 137*b* is molded into all four sides of each panel 10*a*. During panel installation, only the extreme edge of the panel face touches the adjoining panel as is shown. This forms a concealed recessed area 138 (FIG. 16B) between the two panels 10*a*.

To form the seal between the panels 10*a*, foam backer rod 140 is placed as shown, and a suitable sealant 142 is put in place with a caulking gun along the edges of the panels 10*a*. This is done on the first panel after it has been mechanically fastened to the framing. The bead of sealant 142 is placed on the second panel 10*a* just prior to it being slid into place against the first panel. This movement of the second panel compresses the foam backer rod 140 from a circular to an oval shape. The two rubber sealant beads 142 unite and fill the remainder of the recessed area 138 and any excess sealant is squeezed out on the face from whence it is removed.

The visibility of the actual joint between the adjoining panels is visually masked as follows. On the stucco panel profile a light grid pattern is formed dividing the panel face into a series of squares or rectangles. This pattern is only deep enough to eliminate any stucco texture (usually 1/32 inch to 1/16 inch) and create a flat area about 1/4 inch wide. Note that on one long side and one short side of the panel that these flat grid areas come up to the extreme edge of the panel whereas on the opposite sides the stucco pattern comes up to the extreme edges of the panel.

When the panels are abutted during installation, a grid line is formed between the two adjoining panels which is identical to the grid line molded into the center of the panel face. The net effect is to create a concealed panel joint, concealing both the actual sealant material and visually creating the same light grid pattern which is molded into the face of the panel.

On brick profiles, either separate brick face inserts (Add-A-Brick) can be used to span the molded-in brick recesses, or by allowing a hairline joint between the adjoining brick faces. While this creates the hairline joint between every other row of bricks on a running bond brick pattern, its visibility can be greatly reduced by staggering the ends of each row of brick panels so that the abutting brick panels do not form a vertical line running up the wall. On the stacked bond pattern, the joint between panels occurs between the end of the bricks and the vertical mortar joint at the ends of the panel.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. A method of forming a cementitious panel, comprising:

providing a mold configured to provide the desired surface appearance and profile of the cementitious panel;

introducing a cementitious mixture into the mold;

placing a backer into the cementitious mixture prior to curing the cementitious mixture with a backer placement unit which comprises a frame for supporting the mold filled with the cementitious mixture and a vacuum assembly movable between an up position and a down position for lowering the backer into the cementitious mixture prior to curing the cementitious mixture;

curing the cementitious mixture to form a cementitious panel by applying microwave energy to the cementitious mixture for a predetermined time period; and removing the cementitious panel from the mold.

2. The method of claim 1 wherein the cementitious mixture includes a cement mixture which contains from about 25%–75% by weight Portland cement to a quick set cement to about 60%–40% by weight Portland cement to quick set cement.

3. The method of claim 1 further comprising:

applying the microwave energy to the cementitious mixture for a period of from about six minutes to about twenty minutes.

4. The method of claim 1 wherein the backer is constructed of a fire retardant material.

5. The method of claim 1 further comprising centering the cementitious filled mold beneath the vacuum assembly prior to placing the backer into the cementitious mixture.

6. The method of claim 1 further comprising:

positioning a stack of backers placed on a base the same size as the mold into the backer placement unit;

centering the stack of backers beneath the vacuum assembly;

lowering the vacuum assembly to contact the top backer;

producing a vacuum in the vacuum assembly;

raising the vacuum assembly with the backer held in place by the vacuum;

removing the stack of backers from the backer placement unit;

positioning the cementitious mixture filled mold into the backer placement unit;

centering the cementitious mixture filled mold beneath the vacuum assembly;

lowering the vacuum assembly so as to place the backer into the cementitious mixture; and terminating the vacuum in the vacuum assembly; and raising the vacuum assembly.

7. The method of claim 6 further comprising:

pulling air entrapped between the cementitious mixture and the backer through the backer with the vacuum assembly prior to terminating the vacuum in the vacuum assembly.

8. The method of claim 1 wherein the curing step further comprises:

placing the cementitious mixture filled mold into a molecular exciter unit which includes a housing having at least one door opening and at least one microwave energy producing unit mounted to the upper side of the housing such that the microwave energy produced by the microwave energy producing unit is directed downwardly into the housing.

9. The method of claim 8, wherein in the curing step, the cementitious mixture filled mold is placed under the microwave producing units which are arranged on the upper side of the housing such that the outer edges of the mold extends beyond outer edges of the collective microwave producing units.

10. The method of claim 9 further comprising:

supporting the cementitious filled mold in the housing on a roller wheel conveyer.

11. The method of claim 10 wherein molecular exciter unit further includes a door which is movable into a closed position to seal against leakage of the microwave energy.

12. The method of claim 1 wherein in the step of providing the mold, the mold has a rigid base plate, a plurality of cross members, a cast, a cast base, and a plurality of rigid cast support rails, the cast fabricated of an elastomeric material and configured to provide the desired surface appearance and profile of the cementitious panel, the cast being bonded to the rigid cast support rails and the cast base, the cast support rails supporting the edges of the cast while the combination of the cast base, the cross members, and the base plate support the bottom of the cast.

13. The method of claim 12 wherein in the step of providing the mold, the support rails are spaced from the cast base to permit the support rails and the edges of the cast to be flexed downward with respect to the cast base to facilitate removal of the formed cementitious panel.

14. The method of claim 12 wherein in the step of providing the mold, the base plate, the cross members, the cast base, and the cast support rails are constructed substantially of a non-metallic material.

15. The method of claim 12 wherein in the step of providing the mold, the cast of the mold is configured to form a lip along the edge of the building panel so as to provide a recessed area between two adjoining building panels.

16. The method of claim 15 wherein in the step of providing the mold, the edges of the cast are formed to have a first recess formed on two adjacent edges of the cast and a second recess formed on the remaining two edges of the cast.

17. The method of claim 16 wherein in the step of providing the mold, the edges of the cast of the mold are separated from each other thereby allowing the edges of the cast to be flexed downwardly independently of each edge.

* * * * *